United States Patent [19]

Mercier

[11] 4,053,022

[45] Oct. 11, 1977

[54] DEVICE FOR GUIDING A DRILLING STRING DURING UNDERWATER DRILLING

[75] Inventor: Georges Mercier, Boulogne, France

[73] Assignee: Entreprise de Recherches et d'Activites Petrolieres (E.R.A.P.), Paris, France

[21] Appl. No.: 590,100

[22] Filed: June 25, 1975

[30] Foreign Application Priority Data

June 26, 1974 France ..... 74.22257

[51] Int. Cl.[2] ..... E21B 7/12

[52] U.S. Cl. ..... 175/5; 175/7

[58] Field of Search ..... 175/5, 7; 166/.5

[56] References Cited

U.S. PATENT DOCUMENTS

| | | | |
|---|---|---|---|
| 3,142,343 | 7/1964 | Otteman et al. | 175/7 |
| 3,163,239 | 12/1964 | De Vries et al. | 175/7 |
| 3,503,460 | 3/1970 | Gadbois | 175/5 |
| 3,516,488 | 6/1970 | Joubert et al. | 166/.5 |
| 3,528,497 | 9/1970 | Lehman | 175/7 X |
| 3,618,679 | 11/1971 | Crooke | 175/5 |

*Primary Examiner*—Ernest R. Purser
*Assistant Examiner*—Richard E. Favreau
*Attorney, Agent, or Firm*—Brisebois & Kruger

[57] ABSTRACT

Device for guiding a drilling string from a floating drilling rig comprises a flexible guide tube having an inner diameter which is constant and an outer diameter which decreases progressively from its median zone toward each end, the median zone being connected by swivel means to lateral and longitudinal members connected to the floating drilling rig.

This device is especially adapted for floating drilling rigs having a well through which the string descends.

13 Claims, 14 Drawing Figures

DEVICE FOR GUIDING A DRILLING STRING DURING UNDERWATER DRILLING

SUMMARY OF THE INVENTION

The present invention relates to a device for guiding drilling strings in offshore drilling rigs.

On offshore drilling rigs various pipes, and especially the drilling string, carrying at one end the drilling collars and the bit, are started downward through a well which passes through the floor of the drilling rig.

If no means for guiding the string are provided, when the rotary table is rigidly connected to the drilling rig, the lateral forces transmitted by the drilling installation and various stresses created by the drilling tools result in substantial flexing of the drill string, and this may result in permanent deformations or rupture.

When the rotary table is mounted on a swival joint, if no device for guiding the drill string is provided, the defects in alignment between the axes of the various pipe sections and the axis of the derrick resulting from lateral forces leads to difficulties in assembly. The guiding of the drill string beneath the rotary table may then be indispensable when the conditions are unfavorable (rough seas, unstable floating engine, substantial change in the direction in which weight is applied). Various devices have been proposed for this purpose.

Representative examples of the prior art are illustrated in FIGS. 1–3, each of which schematically illustrates one method of controlling the flexing of a drilling string.

The simple ring 1 is shown in FIG. 1A in position around a pipe-section supported from the table and around pipe sections being manipulated in FIG. 1B. This ring may be metallic, or may be made of an elastic material such as plain rubber, or may be hollow and inflated with air. It limits the angular fluttering of the drill string 2 or the angle which the axis of the string makes with the axis of the Kelly at the level of the rotating table 3. This solution is never perfect, because, with a ring of large diameter, the stresses are small but the fluttering is poorly controlled, and with a ring of small diameter the fluttering is limited but the flexing strains are substantial.

The trumpet-shaped guiding device shown in FIG. 2 consists of a guide 1*a* which is a surface of revolution, the generatrix of which surface may be a curve having a constant radius of curvature R, such as the arc of a circle, or a variable radius which decreases substantially from the top to the bottom. This guide means has the same axis as the well in the floor of the rig. With this device, which takes up a substantial amount of space, the angular displacement is effectively limited and the stresses due to flexing are well controlled. The latter may, however, exist even under favorable conditions, and then result in the developement of fatigue phenomena.

Flexible guides, called PICALO, seated in a member fixed to the floating drilling rig 5 are schematically indicated in FIG. 3. They consist of a steel arm 1 mounted beneath a member fixed to the boat or pontoon. The metallic arm 1 defines a cylindrical duct having a circular section. The thickness of the metal of the arm 1 decreases from the top to the bottom so that, under load, the radius of curvature of the median line of the duct is constant. This flexible seated guide constitutes a theoretical solution of the problem if the length of the guide is substantial, that is to say, at least 10 meters. This results in problems of wear, manufacture and mounting, especially because a rapid method of removing it must be provided to permit the passage of the collars and the tool each time the drill string is pulled up.

The present invention makes it possible to alleviate these disadvantages inherent in the various solutions above described by providing a guiding device in the form of a flexible ring supported in swivel means, the center of which ring is movable in a plane perpendicular to the axis of the well in the rig. This ring is constantly subjected to a return force which is an increasing function of the distance between the center of the swivel means and the axis of the well in the rig floor. This device is easy to put in place and remove and makes is possible to adjust the fluttering to the conditions of work encountered and minimize the stresses due to flexing in the drill string.

A device for guiding the drill string according to the invention for use on floating drilling rigs of the type comprising a well for the drilling string, consists of a guide tube in the form of a flexible ring, the internal diameter of the working part of which is constant and equal to 1.1 to 1.4 times the external diameter of the pipe joints.

The external diameter of this flexible ring decreases progressively from its median zone toward its two ends to form the flexible parts of the guiding tube. Taking into account the fact that the thickness (*e*) of the said flexible ring at its ends is at least equal to 4 mm, the ratio of the thickness E of the tube at its median zone to that at (*e*) varies from 4 to 25, and the ratio of the thickness (E) to the total length (L) of the tube (E/L) varies from 0.002 to 0.10. The median zone of the tube is connected by swivel means to members laterally connecting it to the walls of the well. The swivel means comprises an internal part which contacts a spherical part on the outside of the flexible ring. The outer part of this swivel is connected to the rig floor by means of longitudinal connectors.

In the various embodiments the upper and lower ends of the guide tube, or flexible ring, consist of sections which increase in diameter toward the ends of the tube.

In some embodiments the median zone occupies only a third of the total length of the guide tube, the decrease in thickness of the flexible parts on opposite sides of the median zone towards its ends being linear.

In the same embodiments the lateral connecting means comprise mechanisms creating a tension which is an increasing function of any separation between the axis of the guide tube and that of the well in the rig floor.

In a preferred embodiment, the lateral connecting means consists of at least three cables connected to as many fluid jacks through take-up pulleys.

In other embodiments the lateral connecting means consist of at least three fluid jacks directly connected between the central part of the flexible ring and the well in the drilling rig, or an annular casing containing compressed air at a pressure determined by the characteristics of the function defining the return force.

In various embodiments the longitudinal suspension means for the outer part of the swivel consists of three substantially parallel connecting rods of equal length, or a tube connected to the rig by means of a swivel through which the drill string passes.

In other embodiments the longitudinal suspension means consist of a tube which is itself connected to the platform by a swivel or straps.

In these embodiments the swivel may comprise longitudinal ducts for the passage of the mud and it may also comprise means for rapidly assembling it and disassembling it.

In other embodiments the arrangement for rapidly assembling and disassembling the swivel consists in the division of one of the parts of the swivel into two parts along a frusto-conical surface, which decreases in section from top to bottom, the internal part of the swivel being provided with a plurality of fingers which are displaceable in response to the pressure exerted by springs and engage in a groove in the outer part, each of said fingers comprising an upper surface at 45° to the perpendicular and mating with a correspondingly sloping lower surface on a ring which serves as an operating weight during the assembly and disassembly of the swivel.

In other embodiments the arrangement permitting rapid assembly and disassembly consists in the division of the external part of the swivel into two parts along a cylindrical surface having a conical abutment towards its bottom, and safety means for operating the retractable fingers consists of small fluid pressure jacks lodged in the external part of the swivel.

The invention will be better understood from the following description, given purely by way of example, of several embodiments of the present invention illustrated by the accompanying drawings in which.

Figure 1A:
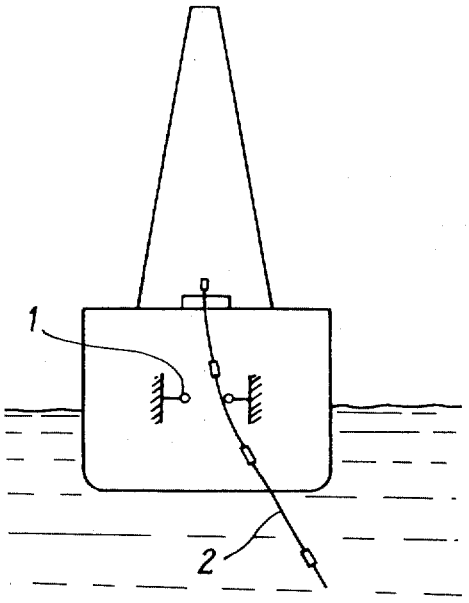
Figure 1B:
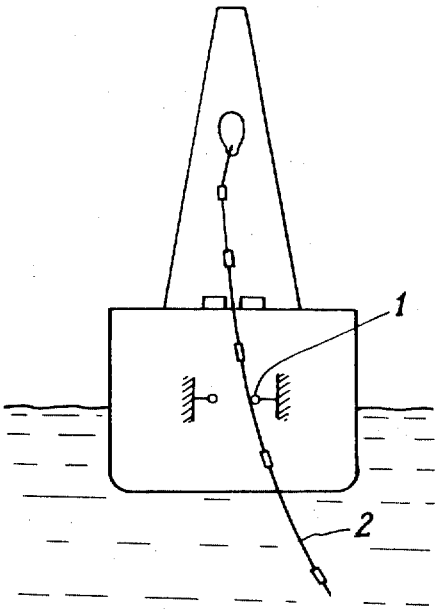
Figure 2:
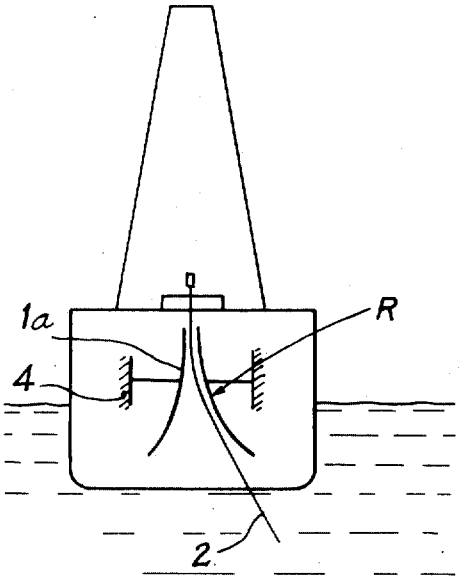
Figure 3:
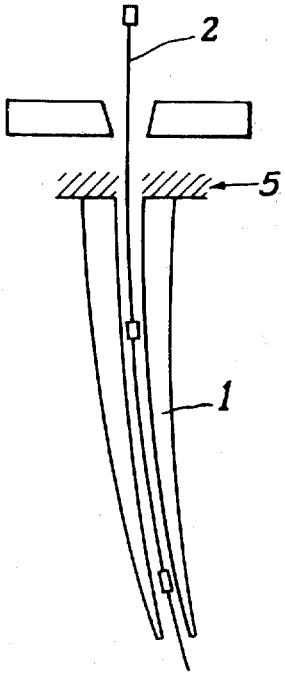
Figure 4:
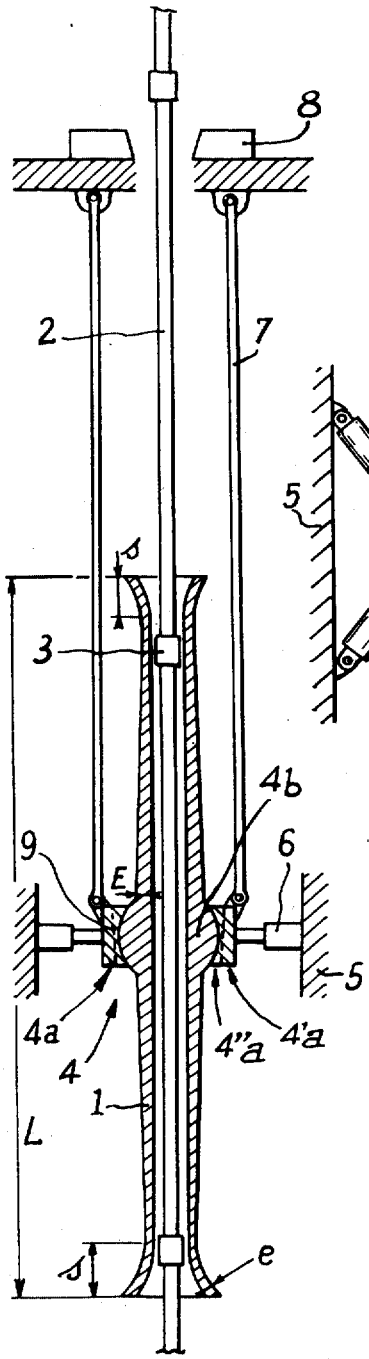
FIG. 4 is a schematic axial sectional view showing a flexible ring with a longitudinal suspension in the form of connecting rods and fluid jacks directly interposed between the median zone of the guide tube and the well in the drilling platform.

Referring now to FIG. 4, this shows a flexible ring 1 for a drill string 2 held together by joints 3. The ring 1 has, except at its ends, a constant internal diameter equal to 1.1 to 1.4 times the external diameter of the joints of the string. The length (L) of the ring includes a median zone (E) of maximum thickness and, on the other hand, two zones over which the thickness decreases from (E) to (*e*) so that the ratio (E/e) varies from 4 to 25 and (E/L) varies from 0.002 to 0.10. The thickness (*e*) at the ends is as small as possible but may not be less than 0.4 cm. The conical input sections (S) are shown at the upper and lower ends.

The median zone may be very short and should not exceed one third of the total length of the flexible ring. The reduction in thickness from (E) to (*e*) on opposite sides of the median zone is generally linear. A swivel joint 4 comprises a concave external part 4*a* rotatable about a convex internal part 4*b* which part is integral with the median zone of the flexible ring, and connects said flexible ring to wall 5 of the well in the platform through lateral connecting members consisting, in this case, of the jacks 6 which are three in number. The longitudinal connection of the guide ring to the floating platform comprises at least three connecting rods 7 pivotally connected at one end to the external part 4*a* and at the other end to the drilling platform in the region of the rotary table 8. The swivel 4 comprises a rapid assembling and dissassembling arrangement indicated here by two symmetrical broken lines 9 inclined to the axis of the flexible ring, defining a frusto-conical surface which divides the external part 4*a* of the swivel joint 4 into two parts 4'*a* and 4''*a*. On FIG. 4 the flexible ring is shown vertical, coaxial with the well in the platform.

Figure 5:
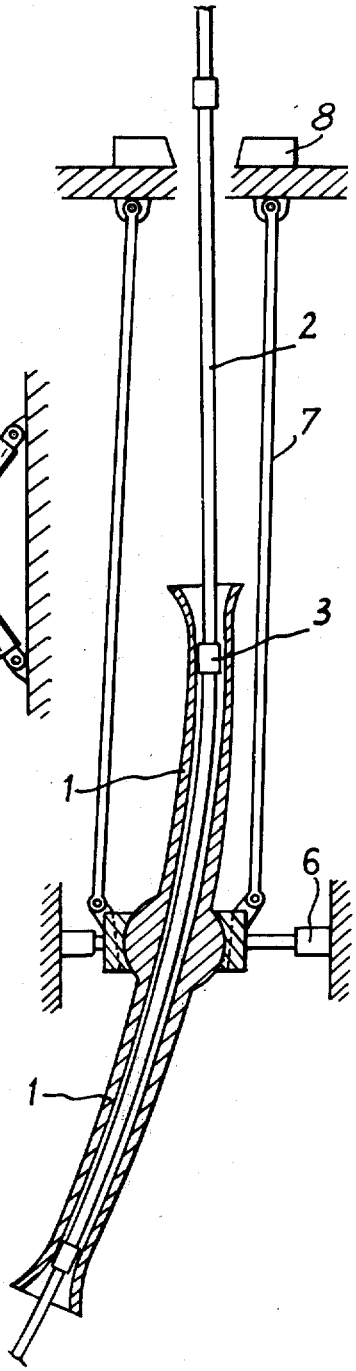
FIG. 5 is an axial sectional view showing the device for FIG. 4 under strain.

On FIG. 5 the guide ring is shown subjected to lateral pull transmitted from the floating platform. The drill string 2 remains perpendicular to the rotary table 8 within several degrees or fractions of a degree, in dependence on the regulation of the return force but the drill string therebeneath assumes a substantial deviation corresponding to the arc of the circle which constitutes substantially the axis of the flexible ring 1. The strain transmitted to the drill string by the floating platform is a function both of the regulation of the return force developed by the jacks 6 following the lateral displacement of the middle of the guide tube and the characteristics determining the flexibility (e.g., length, thickness) of the flexible ring acting as a spring.

Figure 6:
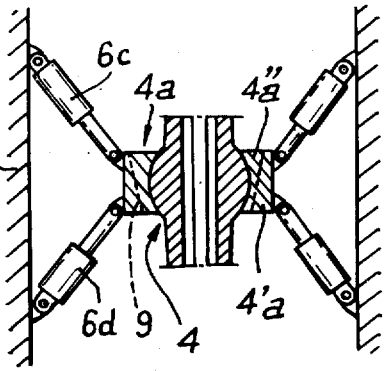
FIG. 6 is an axial sectional view showing a flexible ring with longitudinal and lateral suspension by means of three pairs of fluid jacks.

FIG. 6 shows a particular arrangement of the lateral and longitudinal connections constituted by at least three groups, each consisting of two jacks 6*c* and 6*d* the axes of which are situated in the same meridian plane and inclined in opposite directions.

One end of each jack is pivotally connected to the wall of the well 5 and its outer end is pivotally connected to the external part 4*a* of the swivel 4. In this embodiment, the jacks are connected at predetermined fixed points to the wall of the well. It is necessary that the swivel 4 comprises an arrangement of the type dividing the external part 4*a* into two faces 4'*a* and 4''*a*, to facilitate rapid assembly.

Figure 7:
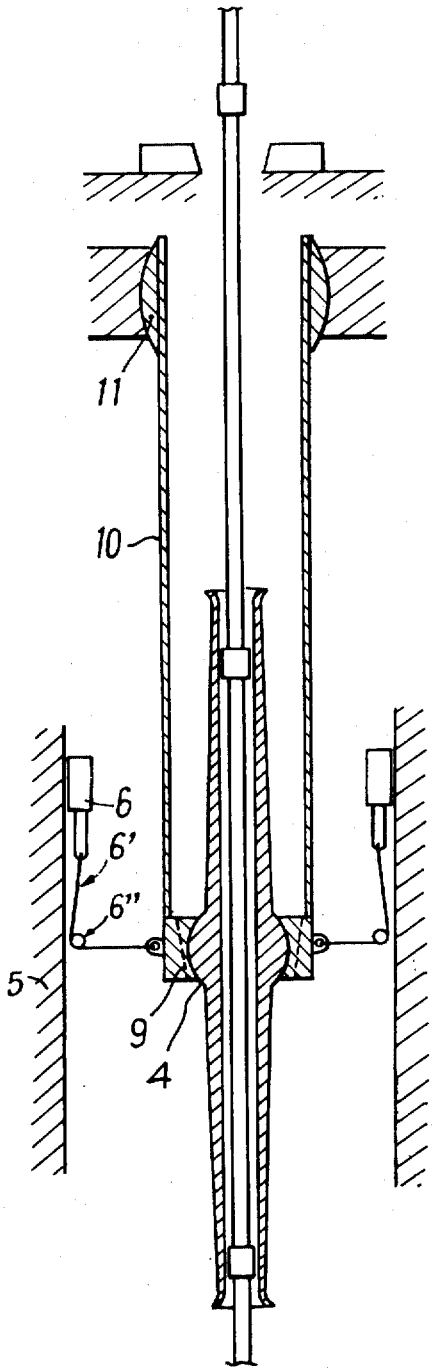
FIG. 7 is an axial sectional view showing a flexible ring which is suspended by means of a swivel by a floating platform, the lateral connection being made by at least three fluid jacks connected by a cable and pulleys to the median part of the well in the platform.

FIG. 7 shows a flexible ring the lateral connections for which consist of at least three jacks 5, cable 6', and take-up pulley 6'', the longitudinal connection being provided by the tube 10 connected to the platform by a swivel joint 11. In this embodiment it is necessary that the swivel 4 comprise an arrangement facilitating rapid assembly at 9, for without this the removal of the tube 10 each time the drill string is brought up, and its remounting, would take up considerable time.

Figure 8:
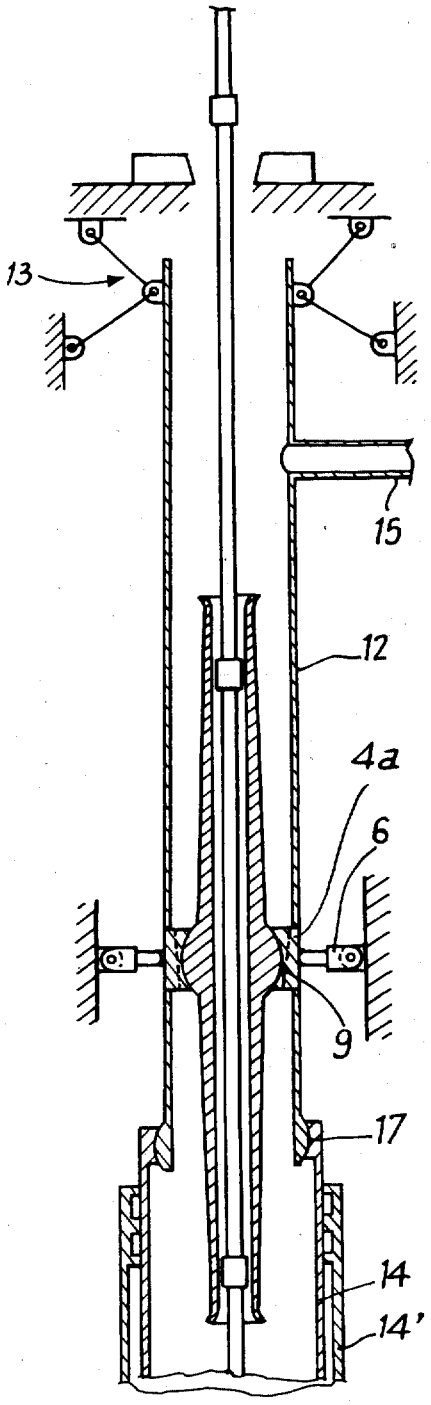
FIG. 8 is an axial sectional view showing a flexible ring mounted in a well tube which is itself connected to the platform by straps.

FIG. 8 shows a flexible ring the lateral connections for which consist of at least three jacks 6 directly interposed between the median zone of the ring and the well, the longitudinal connections being provided by a well tube 12, said well tube being suspended from the platform by means of at least two straps 13 and connected by connecting means 14 adapted to compensate for both the fluctuations of the sea and the pounding of the platform to a tube called an extension tube 14' serving to connect the well tube with the well head, the swivel joint 17 permitting a free orientation of the extension tube. In this embodiment the external part of the swivel joint 4a comprises a rapid assembly arrangement 9 and longitudinal ducts (not shown) for the passage of the mud, when the outlet of the fountain tube is at the top of the fountain tube.

In certain embodiments (not illustrated) in which the maximum compactness of the outer part of the swivel 4a is sought, the provision of longitudinal ducts for the passage of the mud in the outer part of the swivel joint 4a is avoided, and a duct must then be provided in the lower part of the fountain tube for the evacuation of the mud. The upper opening remains indispensable to evacuate the mud passing through the annular space between the guide tube and the drill string.

Figure 9:
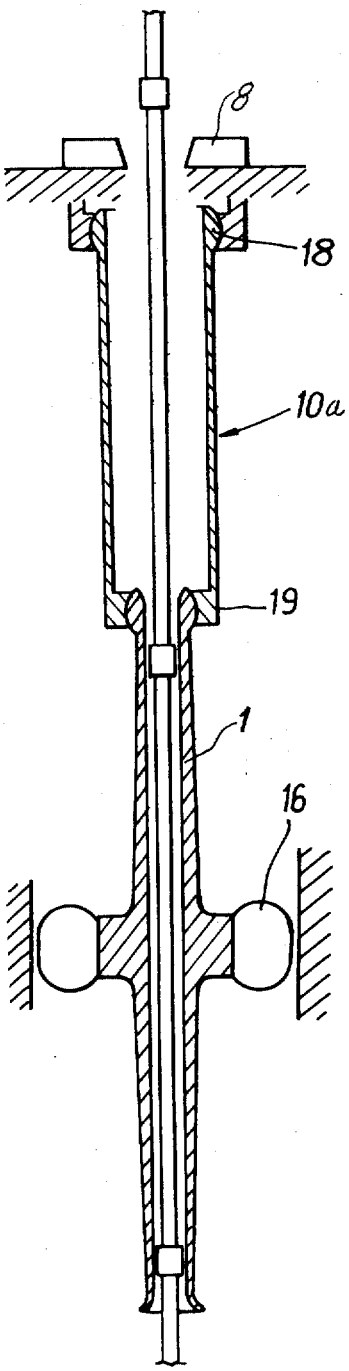
FIG. 9 is an axial sectional view showing a flexible ring connected laterally to the wall of the well in the platform by means of an annular tube containing compressed air and connected longitudinally by means of two swivels at the upper end of the flexible ring.

FIG. 9 shows a flexible ring the lateral connections for which consist of an annular tube 16 containing compressed air. With this method of lateral connection may be associated any one of several types of longitudinal connection, such as rods or tubes suspended from the platform by a swivel joint, a fountain tube, or what is shown, a stationary tube 10a attached to the platform by a swivel 18 and to the upper end of the flexible ring by a second swivel 19, the swivel 4 being then eliminated.

With this method of lateral connection no means for rapid dissassembly has been illustrated. This type of connection is easily separated by opening the swivel 19 which may be swung to the side. This lateral connection utilizing a return force having a rudimentary characteristic may be used to handle tubular materials having large diameters and hence high mechanical strength.

Figure 10:
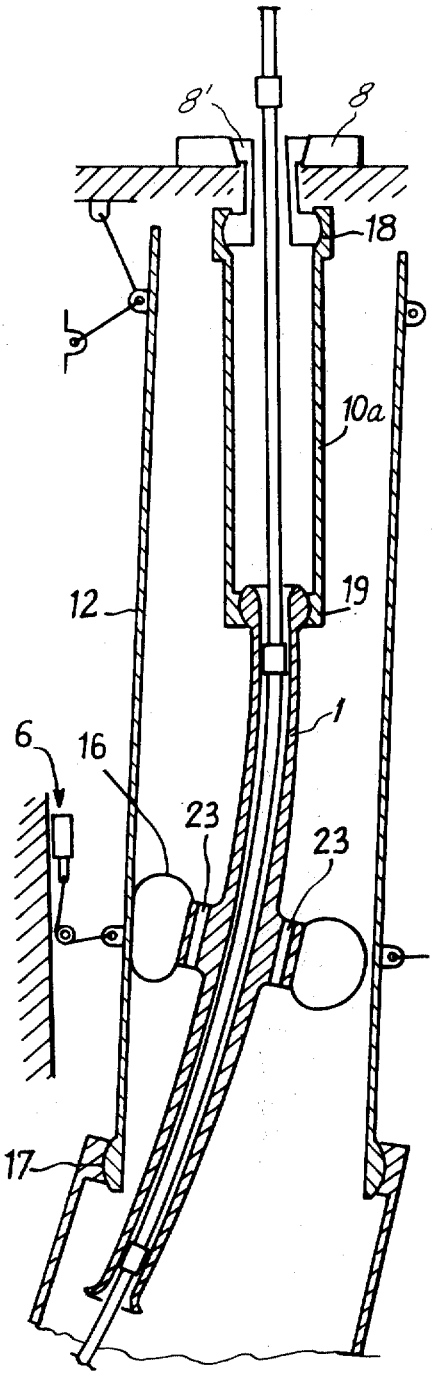
FIG. 10 is an axial sectional view showing the device of FIG. 9 under stress but inside the well tube, the latter being longitudinally attached to the platform by straps and held laterally in its central position by jacks, cables and pulleys.

On FIG. 10 the guide means is shown under load in the fountain tube 12. The longitudinal connection is provided by a tube 10 a connected to the rotating part 8' of the rotary table 8 by a swivel joint 18 and to the flexible ring by a second swivel joint 19. The transverse connection between the fountain tube 12 and the flexible ring is formed by an annular tube 16 which permits free azimuthal orientation between the fountain tube and the well of the platform in reliance on a rudimentary return force law by using at least three jacks with cables and take-up pulleys 6 which make it possible to refine the application of the law of the return force.

Ducts 23 which permit the passage of the mud are shown. On the contrary, a bearing which may be positioned between the tube 16 and the guide tube itself is not shown.

Figure 11:
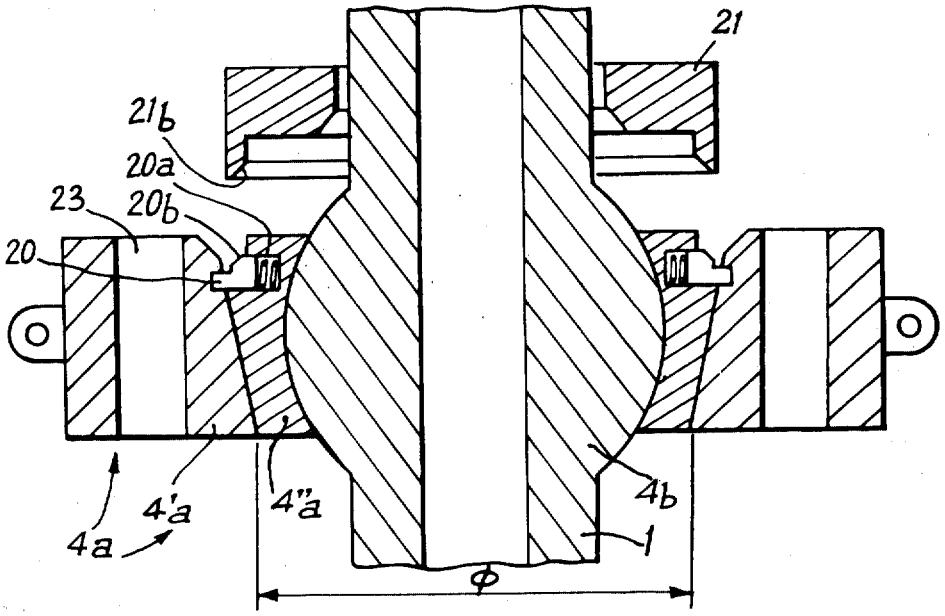
FIG. 11 is a partial axial sectional view showing an arrangement for rapidly assembling and dissassembling.
Figure 12:
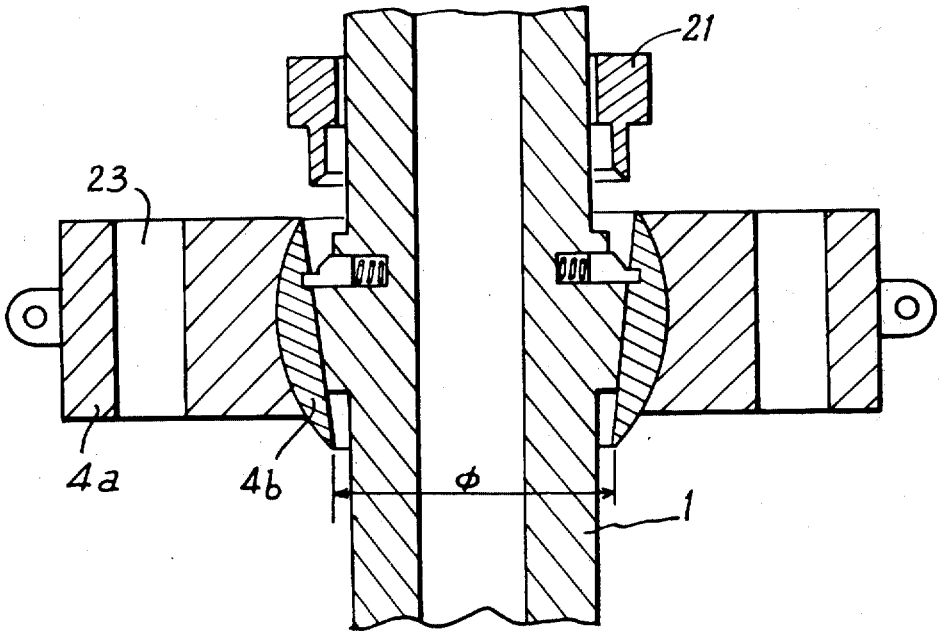
FIG. 12 is a partial axial sectional view showing another arrangement for the same purpose.
Figure 13:
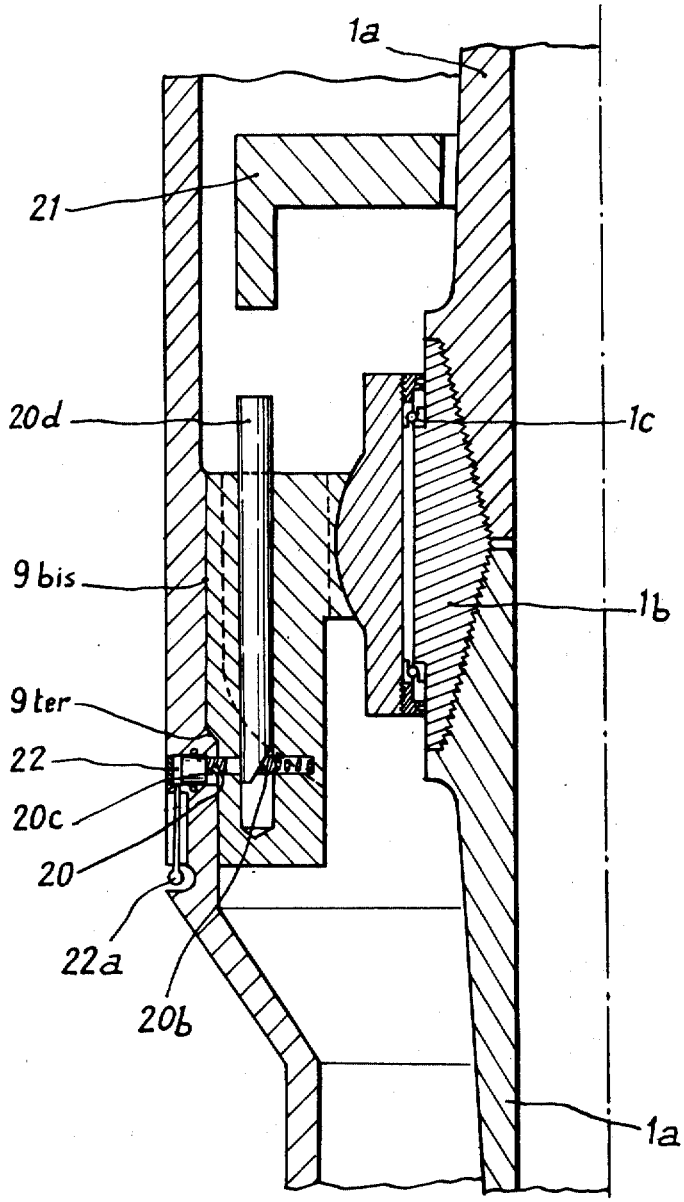

FIGS. 11 and 12 show two embodiments of an assembling and dissassembling arrangement for the swivel 4. FIG. 11 shows that the external part 4a of the swivel is divided into two parts, an external part 4'a and an internal part 4''a, by means of a frusto-conical surface coaxial with the guide tube in a vertical position, which surface tapers inwardly from top to bottom. Fingers 20 mounted to slide in the holes and biassed by springs 20a are positioned on the periphery of 4''a and penetrate cavities of a corresponding shape pierced in the internal periphery of 4'a. The fingers 20 comprise a face 20b champfered at 45° and oriented toward the top. On the periphery of a ring 21 coaxial with the guide tube and constituting an operating weight is a face 21b champfered at 45° and oriented toward the bottom. Pressure by the faces 21b on the faces 20b retracts the fingers 20 into their holes which compresses the springs 20a and releases the guide tube which may then be lifted through the rotary table. On FIG. 12 the mechanism is the same with the separation into two parts taking place in the part 4b of the swivel.

The choice between the devices of FIG. 11 and FIG. 12, or any other results essentially from a consideration of the diameter determining the bulk of the member which is to be manoeuvered through the orifice in the rotary table. The various embodiments described in the figures have the following points in common. They all permit:

1. As substantially free an azimuthal orientation as possible, due to the articulation by swivel joint;

2. Displacement perpendicular to the axis of the string in a plane or on a sphere. This displacement creates a countervailing return force which is a function of the displacement according to a law fixed by the construction, or adjustable in the course of operation to adapt itself to the conditions of work. The law is usually a directly proportional one.

3. Immobility in the longitudinal direction along the axis of the string.

The invention is not limited in its application to the drilling of wells, but may also be used whenever any tubular material must be attached in a working position to a floating platform during the handling steps as well as during the drilling steps per se in which the string is rotating. In the latter case it may be desirable to permit the guide tube to turn about its longitudinal axis.

The medium part will then comprise a system permitting the guide tube to rotate freely. The system may be a spherical ball bearing or roller bearing permitting both rotation and azimuthal orientation or a ball or roller bearing permitting only rotation with the azimuthal orientation being assured by the said swivel.

It is noted that in the various embodiments described in the specification the ring 1 is made with steel whose grade is choosen according to the special design of each type of ring.

What is claimed is:

1. Device for guiding drilling strings for floating installations of the type comprising a platform and a well in said platform for the passage of tubular material, said device comprising a guide tube which consists of a flexible ring the internal diameter of which is constant over most of its length at a value from 1.1 to 1.4 times the external diameter of the joints of the drilling string, the external diameter of said flexible ring diminishing progressively from its median zone toward its two ends which constitute the flexible parts of the guide tube, the minimum thickness of said flexible ring being at least 4 mm, and the ratio of the thickness of the median zone of the guide tube to said minimum thickness lying between 4 and 25, while the ratio of the thickness in the median zone to the total length L of the tube varies from 0.002 to 0.010, a swivel joint connecting the median zone of said guide tube through lateral connecting means to the wall of said well, said swivel joint having an internal part contacting the outside of the ring and defining a spherical surface engaged in an external part, said external part being connected to the platform by means of longitudinal connecting means.

2. Guiding device as claimed in claim 1 in which the upper and lower ends of the guide tube consist of two sections which increase in internal diameter toward the ends of the guide tube.

3. Guiding device as claimed in claim 1 in which the median zone occupies at most one third of the total length of the guide tube, the decrease in thickness of the flexible parts on opposite sides of the median zone toward the ends being linear.

4. Guiding device as claimed in claim 1 in which the longitudinal means suspending the outer part of the swivel from the platform comprises at least three substantially parallel connecting rods of equal length.

5. Guiding device as claimed in claim 1 in which the longitudinal connecting means comprise a tube connected to the platform by means of a swivel joint through which the drill string passes.

6. Guiding device as claimed in claim 1 in which the longitudinal connecting means consists of a well pipe which is itself pivotally connected to the platform.

7. Guide means as claimed in claim 1 in which the external part of the swivel joint comprises longitudinal ducts for the passage of mud.

8. Guide means as claimed in claim 1 in which at least one part of the swivel is divided into two parts by a frusto-conical surface which decreases in section from top to bottom, the innermost of said two parts being provided with a plurality of fingers which are spring biassed into recesses in the outer part, each of said fingers having an upper surface at 45° to the vertical and mating with a surface at 45° to the vertical on the bottom of an annular weight which urges said fingers out of said recesses when the 45° surfaces on said weight are pressed against those on said fingers.

9. Device as claimed in claim 1 in which the outer part of the swivel is divided into two parts along a cylindrical surface having a conical abutment at its bottom, fingers in one of said two parts being projectible by an actuating weight into recesses in the other of said two parts and normally retractable by small jacks.

10. Guiding device as claimed in claim 1 in which the lateral connecting means comprise mechanisms creating a return force which is an increasing function for increasing separation of the axis of the guide tube from the axis of the well in the platform.

11. Guiding device as claimed in claim 10 in which the mechanisms creating a return force comprise at least three fluid pressure jacks.

12. Guiding device as claimed in claim 10 in which the mechanisms creating a return force comprise at least three cables connected to as many jacks through take-up pulleys.

13. Guiding device as claimed in claim 10 in which the lateral connections consist of an annular tube containing compressed air at a pressure determined by the characteristics of the function defining the return force.

* * * * *